US005485880A

United States Patent [19]

Zeuthen

[11] Patent Number: 5,485,880

[45] Date of Patent: Jan. 23, 1996

[54] BLADE SYSTEM FOR A SCRAPED SURFACE HEAT EXCHANGER

[75] Inventor: Klas Zeuthen, Frederiksberg C, Denmark

[73] Assignee: Gerstenberg & Agger A/S, Frederiksberg C, Denmark

[21] Appl. No.: 412,201

[22] Filed: Mar. 27, 1995

Related U.S. Application Data

[63] Continuation of Ser. No. 140,527, Oct. 25, 1993, abandoned.

[30] Foreign Application Priority Data

Oct. 29, 1992 [DK] Denmark ..... 1323/92

[51] Int. Cl.[6] ..... F25C 1/14

[52] U.S. Cl. ..... 165/94; 62/354

[58] Field of Search ..... 165/94; 62/354

[56] References Cited

U.S. PATENT DOCUMENTS 3,216,042 11/1965 Strittmatter ..... 165/94 X
3,235,002 2/1966 Bevarly et al. .
3,385,354 5/1968 Bevarly .
4,282,925 8/1981 Hay et al. .

FOREIGN PATENT DOCUMENTS 0036727 2/1984 European Pat. Off. .
0400700 12/1990 European Pat. Off. .
2232469 12/1990 United Kingdom .

*Primary Examiner*—John C. Fox
*Attorney, Agent, or Firm*—Watson, Cole, Grindle & Watson

[57] ABSTRACT

A blade system for a scraped surface heat exchanger includes a number of blade rows which each consists of a number of successively arranged blade scrapers (1) mounted in cut-outs (15) in the surface of a rotor (4) which is mounted in a heating/refrigerating chamber (20) in the heat exchanger. The individual blades, at the edge closest to the inner wall (21) of the chamber (20) are provided with a knife edge (2) and at the edge facing the rotor (4) with a basis (3). The blades are being provided with flaps (8) which are bent in the direction towards the rotational axis of the rotor (4), while elements (9) on the rotor (4) form abutments for the flaps (8) and engagement members (10) for receiving the basis (3) of the blades so as to permit removal of the blades from the heat exchanger without simultaneously dismounting the rotor (4).

9 Claims, 5 Drawing Sheets

BLADE SYSTEM FOR A SCRAPED SURFACE HEAT EXCHANGER

CROSS-REFERENCE TO RELATED APPLICATION

This application is a continuation of application Ser. No. 08/140,527, filed Oct. 25, 1993, now abandoned.

BACKGROUND OF THE INVENTION

The invention relates to a blade system for a scraped surface heat exchanger.

Scraped surface heat exchangers are particularly suitable for use in the foodstuff industry where they are used for refrigerating or heating fatty products, bakery products and dairy products, such as margarine emulsion and ice cream. A heat exchanger of this type includes a cylindrical treatment chamber, a rotor arranged in the chamber and a number of blade rows including a number of successively arranged blade scrapers mounted on the rotor so as to make the blades scrape the inner surface of the chamber during operation. A refrigerant or a heating medium, e.g. ammonia, freon, glycol, hot water or steam, is circulated on the outside of the treatment chamber and provides heat exchange by a conventional heat exchange process. The treated product is introduced under pressure at the one end of the heat exchanger and leaves the heat exchanger at its opposite end. The scraping of the product off the inner surface of the chamber during its passage through the heat exchanger thereby provides a considerably improved heat transmission.

In known apparatuses the blade scrapers are designed with apertures and/or slits and are secured to the rotor by use of pins or screws or combinations thereof. The use of this securing method makes it necessary to remove the rotor from the treatment chamber during control or replacement of the blades. This is a time consuming operation, and in view of the fact that the manufacturing process must be discontinued in the production line where the heat exchanger is arranged, the control and replacement of the blades are also associated with a considerable financial loss. Furthermore, such screws or pins with corresponding apertures or slits in the blades create dead spots wherein minor amounts of treated product and dirt may accumulate with an ensuing risk of bacteria growth.

GB published patent application No. 2,232,469 discloses such scraped surface heat exchanger wherein the blades are mounted on the rotor by use of hinge means. A similar heat exchanger is known from EP publication No. 400 700. In both cases it is necessary to remove the rotor from the treatment chamber to check or replace the scraper blades.

U.S. Pat. No. 3,385,354 describes, e.g. in FIG. 4, a scraped surface heat exchanger wherein the scraper blades are arranged in a V-shaped cut-out and wherein pins arranged on the rotor pass through apertures or recesses in the blades. Thus, in case of this known heat exchanger, it is also impossible to replace or check the blades without initially removing the rotor from the treatment chamber.

SUMMARY OF THE INVENTION

It is the object of the present invention to provide a blade system for a scraped surface heat exchanger which is so designed as to permit dismounting of the blades without removal of the rotor from the treatment chamber and which simultaneously ensures that the blades are secured in a correct position during rotation of the rotor and also during rotation in directions towards the usual operation direction.

Thereby the blades system permits dismounting of the individual blade by use of a tool which may be introduced into the treatment chamber where it catches or engages with each individual blade for drawing out the latter, the blade and its securing flap being constructed integrally. Hereby control and optional replacement may be carried out substantially faster than usual and the manufacturing losses are substantially reduced. By constructing the engagement member for the blade integrally with the rotor, the formation of dead spots is avoided in connection with screw apertures in the rotor body and thus an improved standard of hygiene is obtained during operation of the heat exchanger.

By imparting a substantially waved appearance to the edge which forms the basis of the blade, i.e., a design without sharp corners, the hygiene standard is further improved.

Thus, the construction of blade and rotor so as to include elements which inhibit the radial and tangential movements of the blades relative to the rotor only requires sealable securing of each blade row at their ends. At the one end it may be in the form of a fixed abutment and at the end intended for removal of the blade, it may be a dismountable securing means mounted in connection with, e.g., a rotor gudgeon.

BRIEF DESCRIPTION OF THE DRAWINGS

A particular embodiment of the invention will now be explained with reference to the non-limiting drawings, wherein.

DETAILED DESCRIPTION OF THE PREFERRED EMBODIMENT

Figure 1:
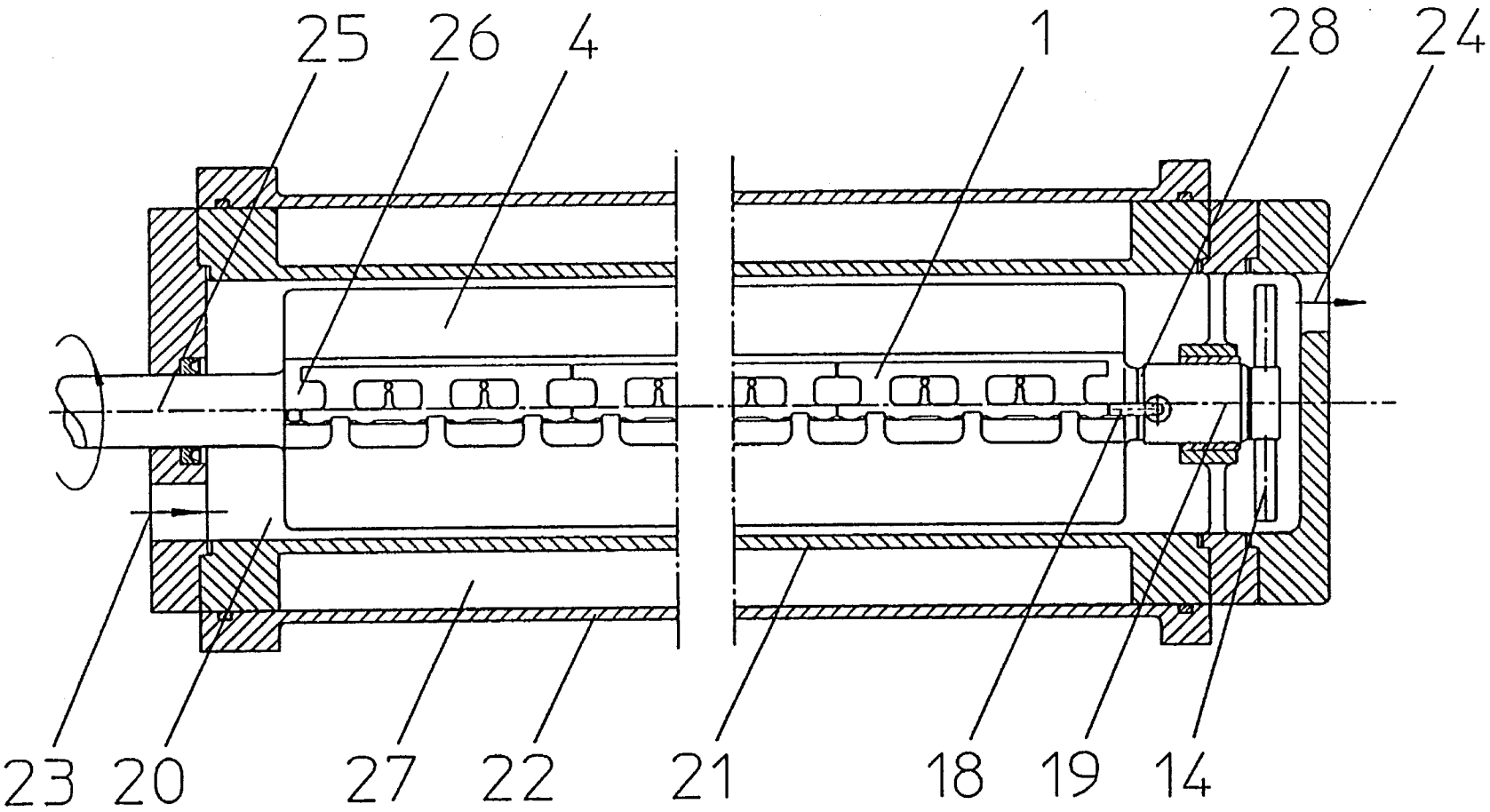
FIG. 1 is a sectional view as seen in the longitudinal direction of a scraped surface heat exchanger mounted with a blade system according to the invention.

FIG. 1 shows a scraped surface heat exchanger comprising a static portion wherein an internal heat transmission pipe 21 delimits a treatment chamber 20. In a chamber 27 between the internal heat transmission pipe 21 and an external pipe 22 a heating medium/refrigerant is circulated which provides heat exchange by a usual heat exchange process. At its one end the treatment chamber 20 is provided with a supply opening 23 and at its opposite end with a discharge opening 24 through which a treated material may pass. In the chamber 20 a rotor 4 is mounted, and on the rotor 4 a number of blade rows 1 are secured at bevels 26 (FIG. 2) on the outside of the rotor 4. The rotor 4 is provided with a shaft 25 which extends through the one end wall of the chamber for communication with a driving means, such as an electric motor (not shown), and with an axially-mounted pin 28 embedded in the opposite end wall of the chamber 20.

Figure 2:
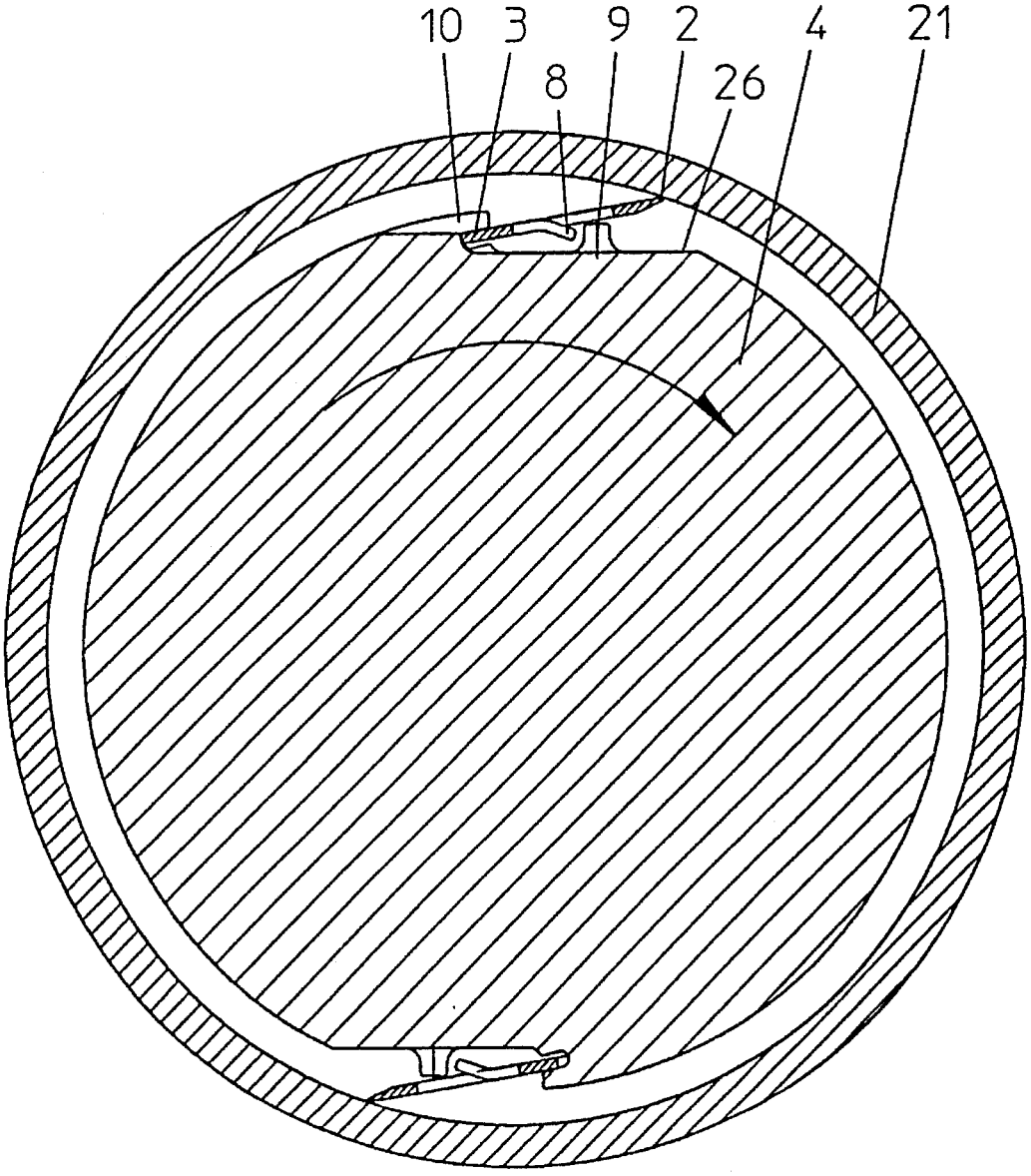
FIG. 2 is a cross sectional view through the scraped surface heat exchanger shown in FIG. 1, FIGS. 3*a* and 3*b* are sideviews of the blade rows in their mounted and dismounted states, respectively.

FIG. 2 is a sectional view through a scraped surface heat exchanger wherein two blade rows of the blade system according to the preferred embodiment are mounted.

Figure 3A:
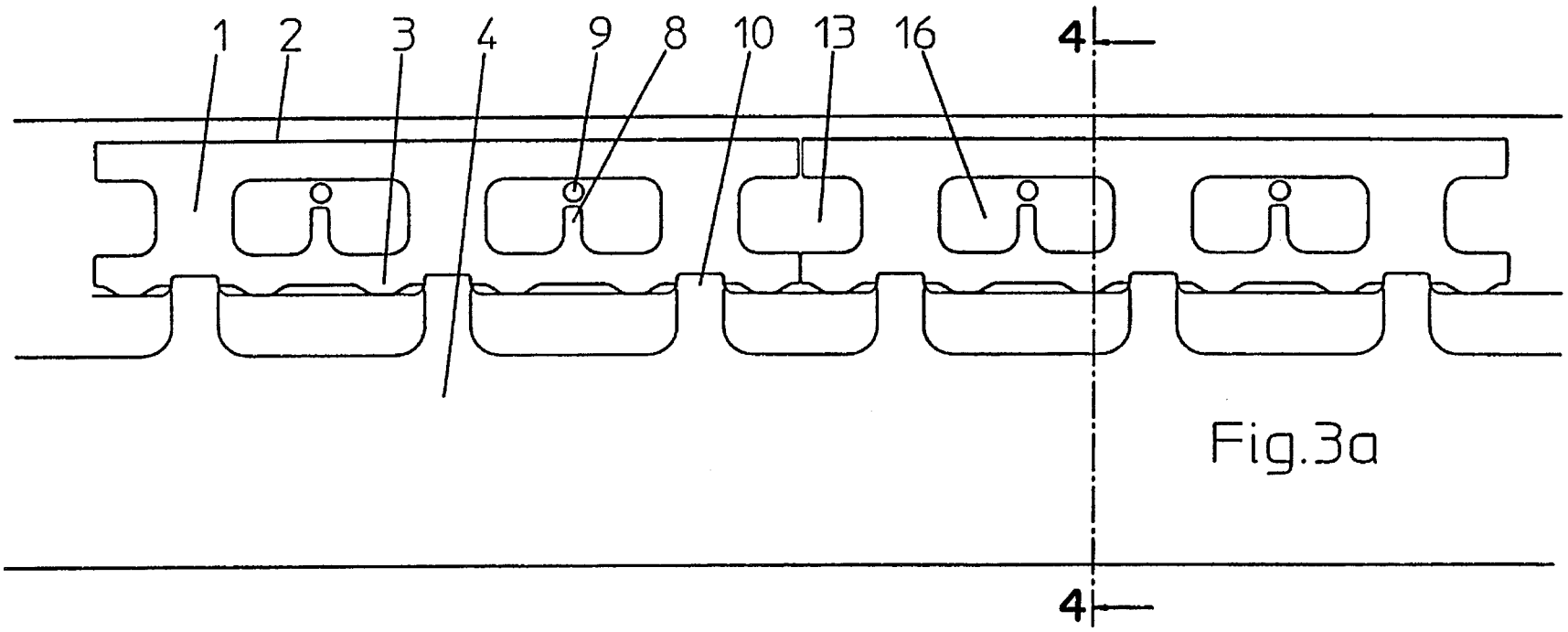
Figure 3B:
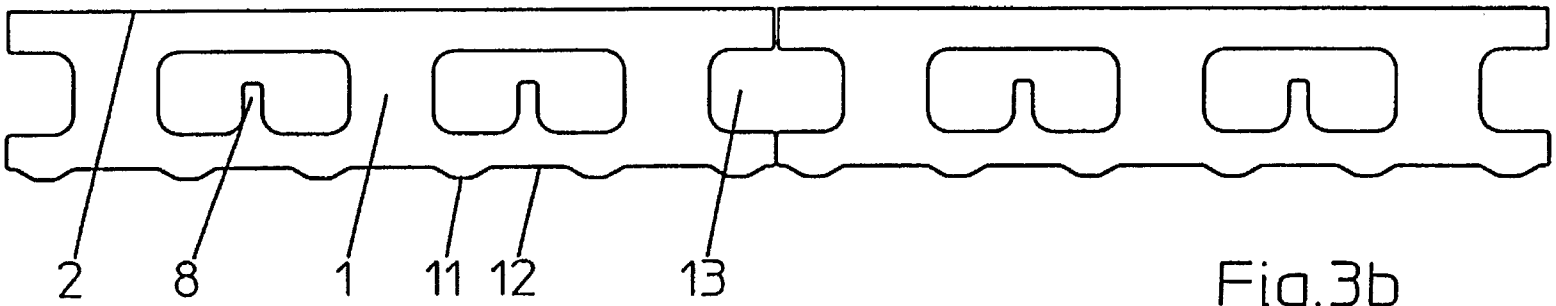

FIG. 3*a* is a sideview of the blade system that includes a number of blade scrapers 1 mounted on the rotor 4, and FIG. 3*b* shows the dismounted blade system.

Figure 4:
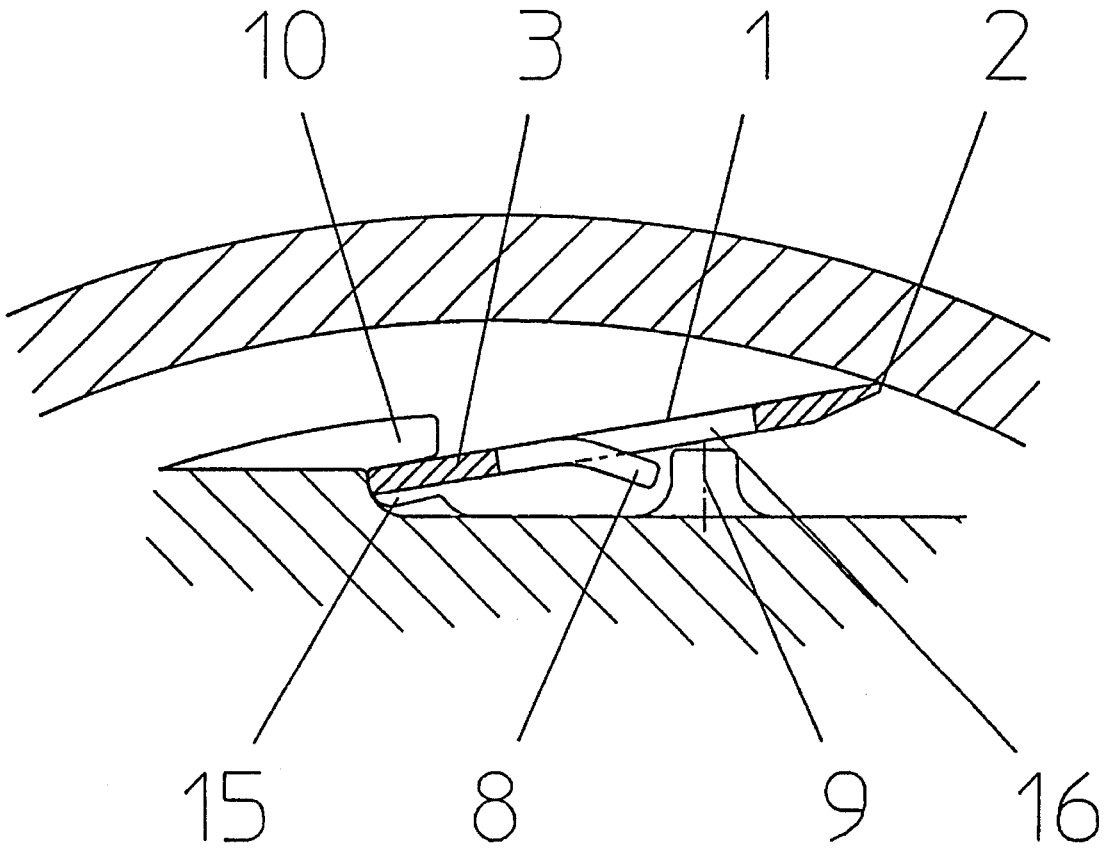
FIG. 4 is a more detailed partially sectional view of a blade row and rotor according to the line 4—4 in FIG. 3.

FIG. 4 is a more detailed sectional side view of a blade. At the edge which is closest to the inner surface of the heat transmission pipe 21, the individual blade is provided with a knife edge 2 and at the edge facing the rotor 4, with a basis 3. Herein between the individual blades may be provided with at least one recess 16 wherein a portion of the blade material extends in the form of a flap 8 which is bent in the direction towards the rotational axis of the rotor 4 (FIG. 4). At the bevels 26 the rotor 4 is provided with protruding pins 9, on which the flaps 8 may abut. Moreover, the rotor is constructed with engagement members 10 for receiving the blade basis 3.

Figure 5:
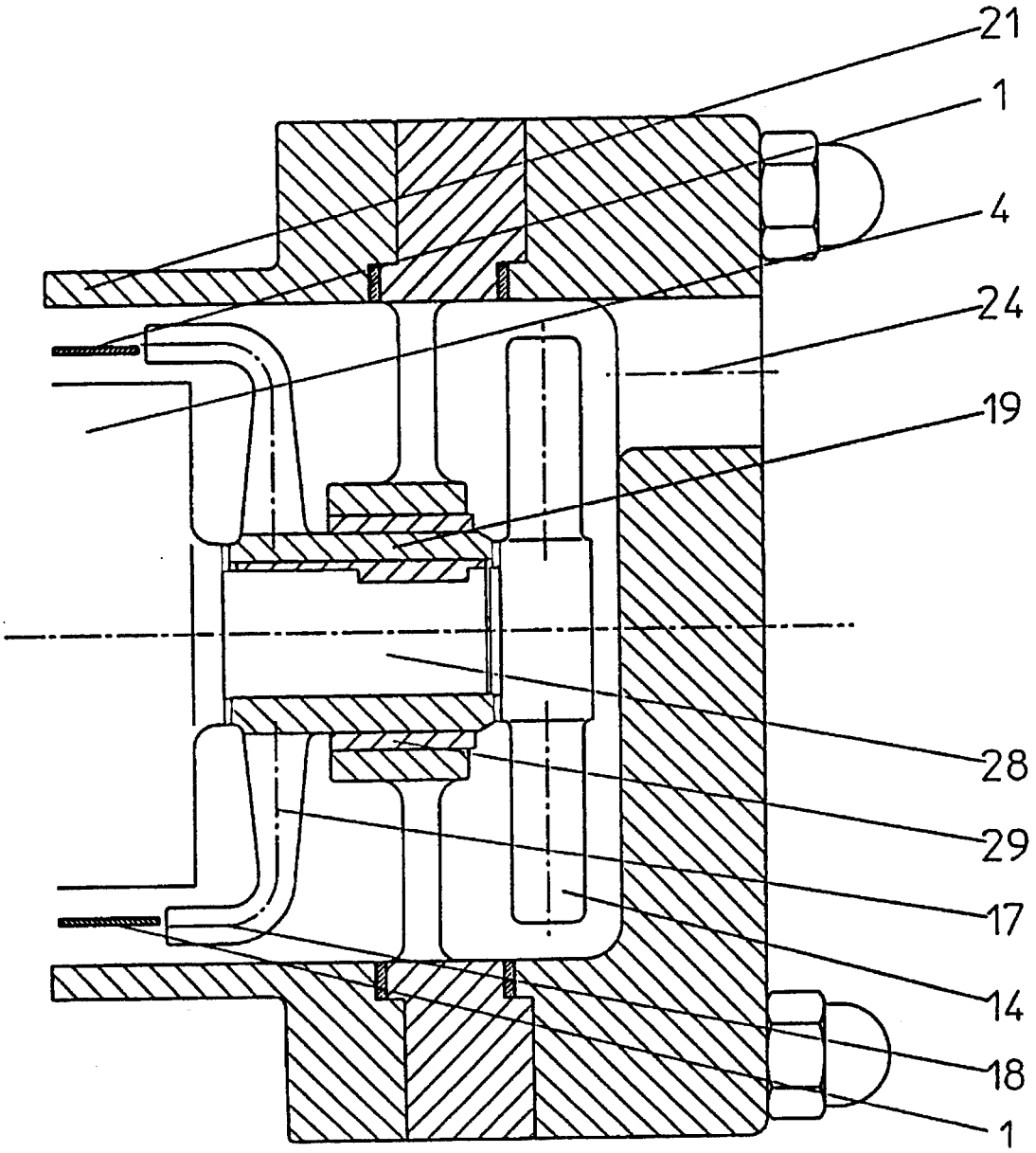
FIG. 5 is an axial sectional view illustrating a securing means for a blade row at the rotor bearing.

During usual operation the rotor rotates in the direction indicated by the arrow, cf. FIG. 2, in such a manner that the engagement members 10 alone ensure that the blades are secured in a correct scraping position. In connection with, e.g., cleaning, the rotor 4 may optionally be caused to rotate in the opposite direction and the flaps 8 will then abut on the adjacent sides of the pins 9 and ensure that the blades 1 are secured relative to the rotor 4. Thus, irrespective of the rotational direction of the rotor 4, radial and tangential securing of the blades relative to the rotor 4 is ensured. At their one end the blade rows are secured in an axial direction by use of a securing means 17,18, cf. FIG. 5. The securing means 17,18 may for example be mounted in connection with the rotor pin 28. The securing means 17,18 may be dismounted by use of a handle 14, and after removal of the end wall of the chamber 20, the blades 1 may be removed when the securing means has been dismounted. The securing means comprises arms 18 for securing the individual blade row, which arms 18 are secured to a sleeve 19 which is displaceable on the rotor pin 28 and mounted in a bearing 29.

For the sake of hygiene the basis 3 of the individual blades is of a substantially wave-shaped construction, cf. FIGS. 3*a* and 3*b*, with wave crests 11, which in the mounted state abuts on the rotor 4, and wave troughs 12 which extend substantially parallel to the knife edge 2. In each blade row several blades 1 are successively arranged, and where the individual blades abut on each other they are provided with U-shaped or arched recesses 13 to minimise the extent of dead spots and at the same time to facilitate cleaning of the apparatus.

The engagement members 10 are so positioned (FIG. 3*a*) that they abut on the blade basis 3 between wave crests 11. Thereby the formation of dead spots between the engagement members 10 and the blade, where bacteria growth may occur, is avoided.

During operation of the surface scraped heat exchanger, a foodstuff is introduced under pressure into the heat exchanger through the opening 23. During its passage through the chamber 20 the viscosity of the foodstuff changes due to changes in temperature, and therefore portions of the treated material will stick to the wall. This results in deterioriated heat transmission. When the rotor 4 with the blades 1 rotates in the direction indicated by the arrow as shown in FIG. 2, the blades 1 will scrape the food substance which sticks to the inside of the refrigerating/heating pipe, thereby enhancing efficient heat transmission so as to allow refrigeration/heating of the foodstuff to be effected in a continuous heat exchange process. Following treatment the foodstuff leaves the heat exchanger through the opening 24 (FIG. 1).

If the blades are to, be checked or replaced due to e.g., wear, the dismounting is effected by removal of the securing means 17,18, whereupon a catching tool is caused to engage with a recess 16 in a blade and in the axial direction it draws it out of the rotor without removing the rotor as such from the apparatus. The mounting of the blades is effected by pushing them into position in the rotor (4) still without dismounting the latter.

During cleaning the rotor may, as mentioned above, optionally be caused to rotate in the opposite direction. The blade basis 3 is thereby lifted off the bottom of the cut-out 15 of the engagement member 10 until the flap 8 abuts on the pin 9 and the cleaning is thus facilitated. Detergents are then conveniently introduced and removed through the openings 23,24 as are also used for the passage of the treated material through the heat exchanger. The present invention makes it possible to clean a heat exchanger efficiently in about 15 minutes whereas it has required as much as two hours in case of blades mounted by use of known securing means.

I claim:

1. A scraped surface heat exchanger comprising cylindrical wall means for defining an elongated inner treatment chamber through which a material to be treated can flow, said wall means providing an inner surface facing the treatment chamber; an elongated rotor rotatably mounted within said treatment chamber, said rotor defining a peripheral outer surface and mounting a first abutment means and a second abutment means spaced from the first abutment means, said second abutment means comprising a pin which extends away from the peripheral outer surface; and an elongated scraper blade positioned between the rotor and the cylindrical wall means, said scraper blade providing a longitudinal base which abuts said first abutment means when the rotor is rotated in one direction, and an opposite longitudinal knife edge which is positionable against the inner surface of the cylindrical wall means to scrape said inner surface when the rotor is rotated in said one direction, said scraper blade also including a flap which extends towards said rotor to abut said second abutment means when the rotor is rotated in an opposite, second direction, said scraper blade being removable from the treatment chamber without removal of the rotor by gripping an end thereof and sliding said scraper blade in a longitudinal direction thereof.

2. A scraped surface heat exchanger according to claim 1, wherein the longitudinal base of said scraper blade is wave shaped, thereby providing wave crests and wave troughs.

3. A scraped surface heat exchanger according to claim 2, wherein said wave crests and wave troughs define free edges that lie in respective imaginary lines that are parallel to said longitudinal knife edge.

4. A scraped surface heat exchanger according to claim 2, wherein said first abutment means comprise a plurality of engagement members which are spaced apart in a longitudinal dimension of the rotor so as to engage said longitudinal base of said blade between wave crests thereof.

5. A scraped surface heat exchanger according to claim 1, wherein said first abutment means comprises an elongated element protruding from the peripheral outer surface of the rotor, said elongated element including generally U-shaped cut-out portions, thereby defining a plurality of protruding fingers.

6. A scraped surface heat exchanger according to claim 1, wherein said scraper blade includes a plurality of said flaps which extend towards said rotor, said flaps comprising bent cut-out portions from a central area of said scraper blade.

7. A scraped surface heat exchanger according to claim 1, including a plurality of said scraper blades aligned end-to-end between said rotor and said cylindrical wall means, and wherein each end of each scraper blade defines a recess therein.

8. A scraped surface heat exchanger according to claim 7, including means to position said plurality of scraper blades together.

9. A scraped surface heat exchanger according to claim 7, wherein said rotor defines a rotor pin at one end thereof, wherein a bevel is mounted around said rotor pin and wherein said means to connect said plurality of scraper blades together is mounted on said bevel, said bevel being removable from said rotor pin to enable said scraper blades to be moved in the longitudinal direction.

* * * * *